US007726786B2

(12) United States Patent
Therien et al.

(10) Patent No.: US 7,726,786 B2
(45) Date of Patent: Jun. 1, 2010

(54) VENT CHAMBER

(75) Inventors: Patrick J. Therien, Battle Ground, WA (US); David N. Olsen, Corvallis, OR (US); Curt G. Gonzales, Corvallis, OR (US); Steven N Miller, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 366 days.

(21) Appl. No.: 10/947,514

(22) Filed: Sep. 22, 2004

(65) Prior Publication Data

US 2006/0061637 A1 Mar. 23, 2006

(51) Int. Cl.
*B41J 2/175* (2006.01)

(52) U.S. Cl. ..... 347/85

(58) Field of Classification Search ..... 347/84–86, 347/92; 180/69.4; 261/23.2
See application file for complete search history.

(56) References Cited

U.S. PATENT DOCUMENTS 3,764,119 A * 10/1973 Niebrzydoski ..... 261/23.2
3,805,276 A * 4/1974 Ishii ..... 347/85
3,874,471 A * 4/1975 Kloefkorn ..... 180/69.4
4,301,459 A * 11/1981 Isayama et al. ..... 347/19
4,462,037 A * 7/1984 Bangs et al. ..... 347/85
5,367,328 A * 11/1994 Erickson ..... 347/7
5,841,455 A * 11/1998 Tanaka et al. ..... 347/87
5,963,237 A * 10/1999 Ikkatai et al. ..... 347/85
6,234,621 B1 * 5/2001 Musser et al. ..... 347/92
6,481,837 B1 * 11/2002 Askren et al. ..... 347/85
6,536,886 B1 * 3/2003 Mott ..... 347/85
2002/0047882 A1 * 4/2002 Karlinski et al. ..... 347/85

* cited by examiner

*Primary Examiner*—Stephen D Meier
*Assistant Examiner*—Geoffrey Mruk

(57) ABSTRACT

A device is disclosed. In one example embodiment, the device includes a fluid ejection mechanism, a reservoir, and a pump configured to pump fluid between the fluid ejection mechanism and the reservoir. A vent chamber is fluidly coupled to the reservoir.

35 Claims, 5 Drawing Sheets

VENT CHAMBER

BACKGROUND

In inkjet printing, froth is sometimes generated as ink travels through an ink delivery system. This froth may be undesirable in some applications where it is difficult to print with froth. Also, the froth may consume volume within the ink supply system that could otherwise be consumed by ink.

DETAILED DESCRIPTION

Figure 1:
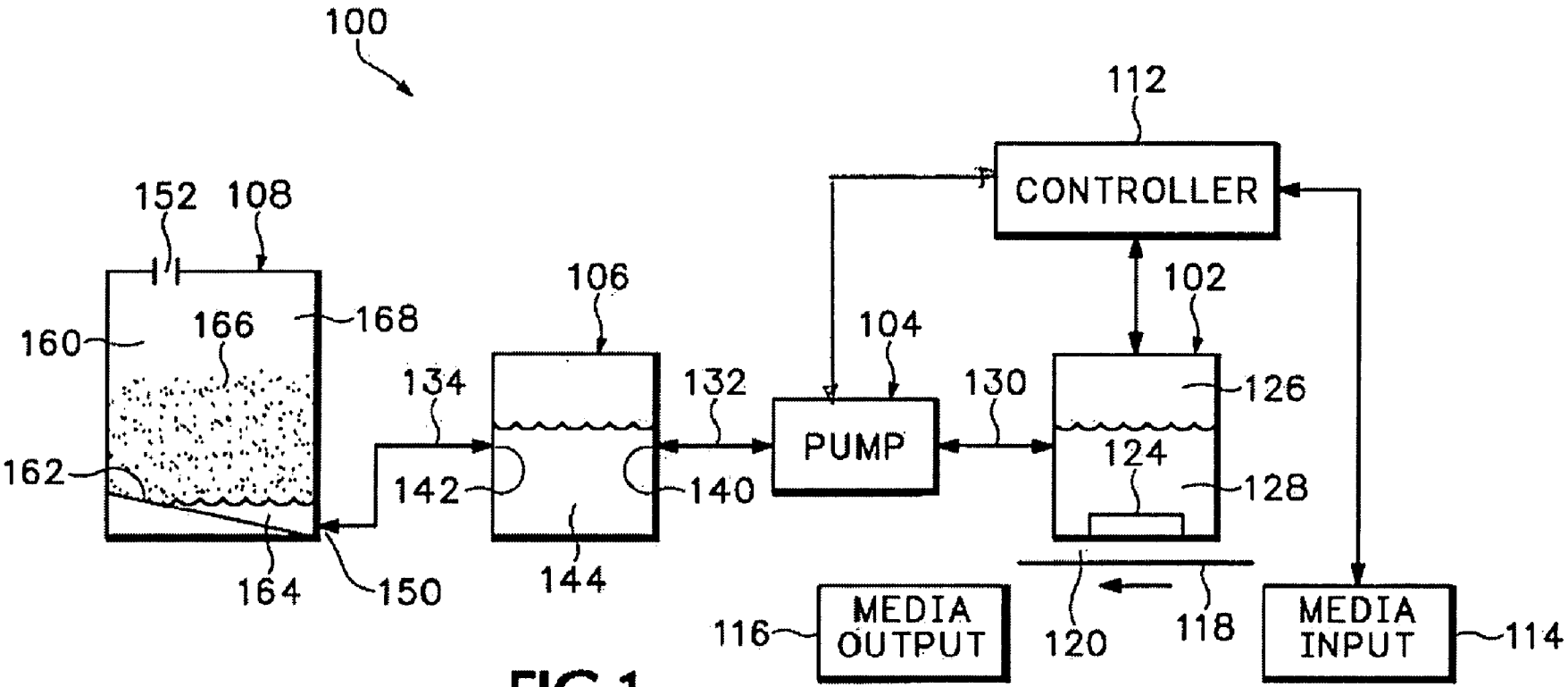
FIG. 1 is a schematic diagram illustrating a portion of an imaging device in accordance with an example embodiment.

FIG. 1 schematically illustrates a portion of an imaging device 100 in accordance with an example embodiment. The imaging device 100 generally includes a print head assembly 102, a pump 104, a reservoir 106, and a vent chamber 108. A controller 112 controls operation of the pump 104, the print head assembly 102, and media input system 114. The media input system 114 may comprise rollers, belts, or the like and advances media 118 from the media input system 114, through a print zone 120, to the media output 116.

The print head assembly 102 generally ejects fluid, such as ink, onto the media 118 while the media 118 is in the print zone 120 to at least partially form an image on the media 118. The print head assembly 102 is a fluid ejection mechanism and is shown as including at least one print head 124 and a cavity 126 that may include ink 128. The print head 124 is configured to eject fluid, such as ink, according to input received from the controller 112.

A fluid conduit 130, such as a flexible tube, extends between the print head assembly 102 and the pump 104 and serves to permit ink, air, and froth to travel between the print head assembly 102 and the pump 104. A fluid conduit 132 is also disposed between the pump 104 and the reservoir 106 to permit ink, air, and froth to travel between the pump 104 and the reservoir 106. In some embodiments, the tubes 130, 132 comprise distinct, separate tubes. In other embodiments, however, the tubes 130, 132 comprise a single tube that extends through the pump 104. The pump 104 may comprise, for example, a peristaltic pump.

The reservoir 106 has fluidic interfaces 140, 142, respectively coupled to fluid conduits 132, 134. As shown in FIG. 1, the reservoir 106 also has a supply of ink 144 disposed therein. In some embodiments, the pump 104 may advance ink 144 from the reservoir 106 to the print head assembly 102. The pump 104 may also advance ink, air, and froth, from the print head assembly 102 to the reservoir 106. Further, in accordance with some example embodiments, the reservoir 106 comprises a component that is easily removed and replaced such that the quantity of ink in the device 100 may be increased by removing a reservoir 106 that is partially or substantially empty and replacing it with a reservoir 106 that is full, or substantially full of ink or other suitable fluid.

The vent chamber 108 includes at least one fluidic interface 150 coupled to the conduit 134 and a port 152 exposed to atmosphere. As discussed below, in some embodiments, the port 152 may include a labyrinth structure. The vent chamber 108 is further shown in FIG. 1 as including a cavity 160 and sloped bottom surface 162. The cavity 160 may include, for example, ink 164, froth 166, air 168, or a combination of these. The bottom surface 162 is sloped such that the fluidic interface 150 is positioned at or adjacent a lower end of the sloped bottom surface 162 so that most of the ink 164 can be drawn into the conduit 134 before significant amounts of froth 166 or air 168. The sloping of the bottom surface 162 is optional.

The vent chamber 108, in some embodiments, may serve as an overflow container and provides a location for froth 166 to accumulate and coalesce into ink 164. Moreover, in some embodiments, the ink 164 may then be transported back to the print head assembly 102 for printing. In the example embodiment shown in FIG. 1, the ink 164 is transported from the vent chamber 108 to the print head assembly 102 via the conduits 134, 132, and 130 under influence of the pump 104.

Figure 2:
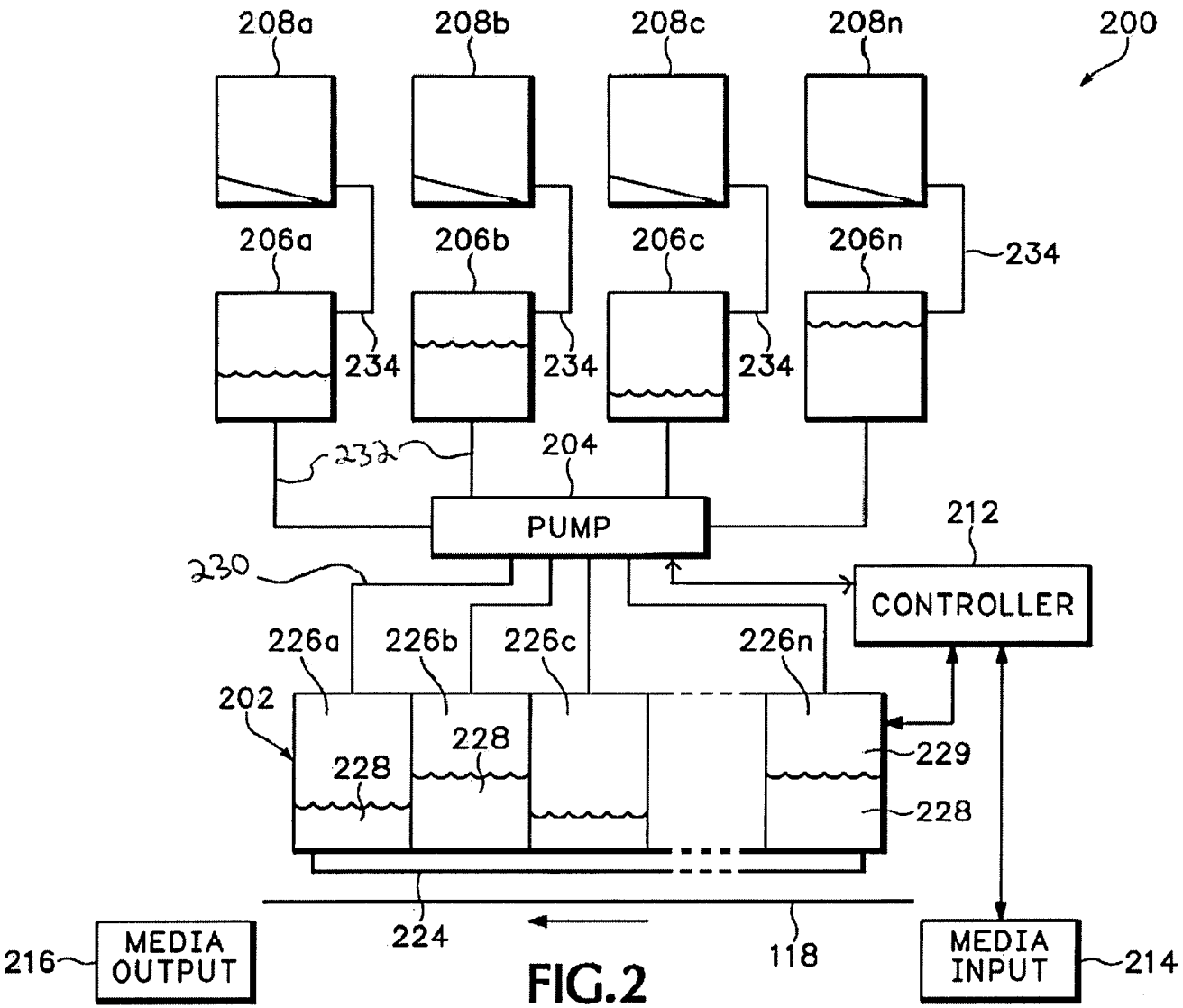
FIG. 2 is a schematic diagram illustrating a portion of an imaging device in accordance with another example embodiment.

FIG. 2 schematically illustrates a portion of an imaging device 200 in accordance with another example embodiment. The imaging device 200 generally includes a print head assembly 202, a pump 204, reservoirs 206*a*, 206*b*, 206*c*, 206*n*, and vent chambers 208*a-n*. A controller 212 controls operation of the pump 204, the print head assembly 202, and media input system 214. The media input system 214 and media output 216 may be configured similar to the media input system 114 and the media output 116 described above. Each of the reservoirs 206*a-n* may be configured identically to the reservoir 106 described above.

The print head assembly 202 is a fluid ejection mechanism similar to the print head assembly 102 described above and is shown as including at least one print head 224 and cavities 226*a*, 226*b*, 226*c*, and 226*n* that may include ink 228 and air 229. The print head 224 is configured to eject fluid, such as ink, according to input received from the controller 212. In some embodiments, the print head assembly 202 includes multiple print heads 224, each print head may be associated with an ink of a different color.

Fluid conduits 230, which may comprise flexible tubes, extend between the print head assembly 202 and the pump 204 and serve to permit ink, air, and froth to travel between the print head assembly 202 and the pump 204. Fluid conduits 232 are also disposed between the pump 204 and the reservoirs 206*a-n* to permit ink, air, and froth to travel between the pump 204 and the reservoirs 206*a-n*. The pump 204 may comprise a single pump or multiple pumps. In some embodiments, the pump 204 comprises a peristaltic pump.

Each of the reservoirs 206*a-n* is fluidly coupled to an associated vent chamber 208*a-n* via one of the fluid conduits 234. In one embodiment, each of the vent chambers 208*a-n* is configured identical to the vent chamber 108 described above with reference to FIG. 1. The vent chambers 208*a-n* may be discrete, separate members. Alternatively, the vent chambers 208*a-n* may be co-housed and may share walls. In an example embodiment, the vent chambers 208*a-n* are arranged vertically relative to each other and are molded together as a plastic part. The specific configuration and material used to form the vent chambers 208*a-n* may, of course, vary.

Figure 4:
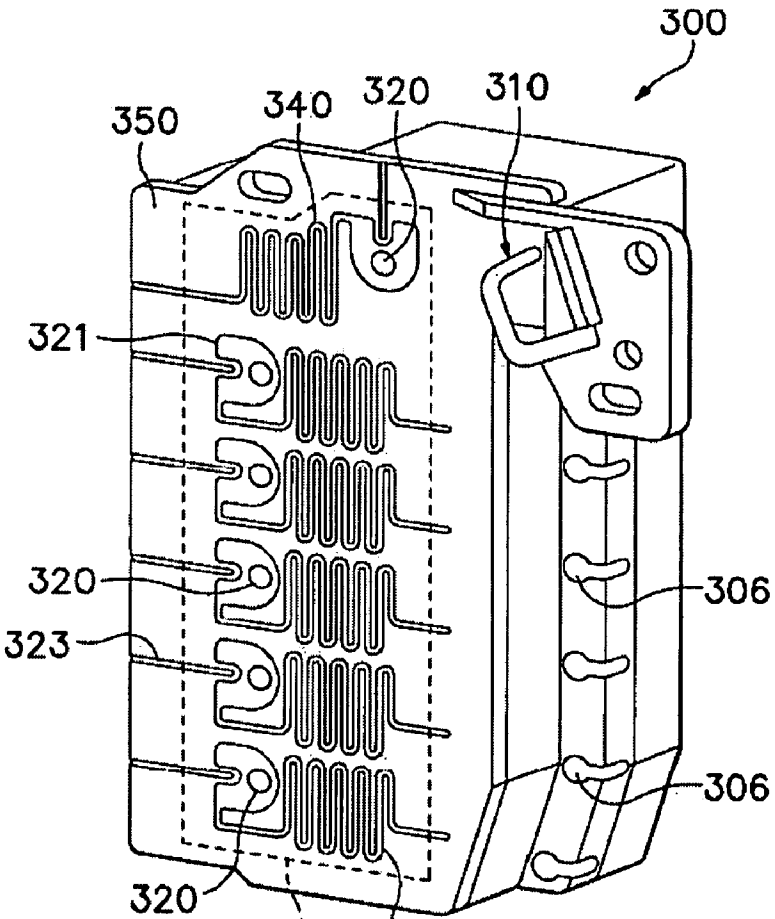
FIG. 4 is a perspective view of the vent chamber of FIG. 3 in accordance with an example embodiment.
Figure 3:
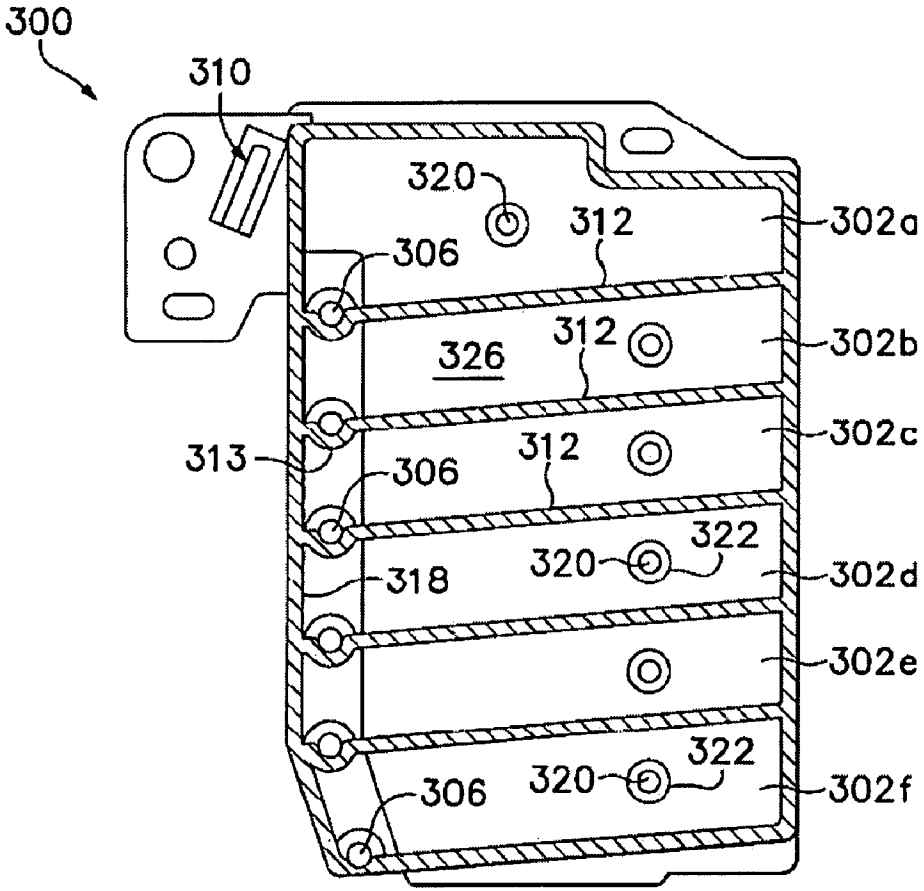
FIG. 3 is a sectional view of a vent chamber in accordance with an example embodiment.

FIGS. 3 and 4 illustrate an example embodiment of a vent chamber 300. The vent chamber 300 may be used in an imaging device, such as the imaging device 200 shown in FIG. 2 by replacing the vent chambers 208*a-n*. As shown, the vent chamber 300 includes cavities 302*a*, 302*b*, 302*c*, 302*d*, 302*e*, 302*f*. Fluidic interfaces 306 are formed in the vent chamber 300. Each fluidic interface 306 is in fluid communication with one of the cavities 302*a-f*. The fluidic interfaces 306 may be coupled to fluid conduits, such as fluid conduits 234 (FIG. 2), to fluidly couple one of the cavities 302*a-f* to one of the reservoirs 206*a-n*. As shown, the fluidic interfaces 306 are vertically aligned, adjacent each other and are formed on a common side of the vent chamber 300 to facilitate coupling of fluid conduits to the fluid interfaces 306. The fluidic interfaces 306 may each comprise an aperture leading into an associated cavity. In some embodiments, the fluidic interfaces also comprise barbs or the like for facilitating coupling of a tube or other suitable conduit thereto.

An optional clip 310 is provided to maintain fluid conduits (not shown), such as conduits 234 (FIG. 2) while the conduits 234 are coupled to the interfaces 306. In the embodiment shown in FIGS. 3 and 4, the clip 310 is formed on a same side of the vent chamber 300 as the fluidic interfaces 306.

Each of the cavities 302*a-f* includes a bottom surface 312 that is sloped downward toward a fluidic interface 306. In an example embodiment, the bottom surface 312 is oriented at an angle in the range of about 3 to 15 degrees relative to side surface 318. In another embodiment, the bottom surface oriented at an angle in the range of about 5-10 degrees relative to the side surface 318. For each cavity, the lower portion or end of the bottom surface 312 is at or adjacent a fluidic interface 306. The slope of the bottom surface 312 assists ink, such as coalesced ink, in one of the cavities 302*a-f* to flow to the associated fluidic interface 306 under the influence of gravity. This may facilitate moving ink in one of the cavities 302*a-f* to an associated reservoir, such as one of the reservoirs 206*a-n* (FIG. 2). A recessed portion 313 of the surface 312 may also be formed adjacent each interface 306 and may provide a location for ink, such as coalesced ink, to pool. In some embodiments, each interface 306 is at least partially disposed within the recessed portion.

Each of the cavities 302*a-f* also includes a port 320. Each port 320 fluidly couples an associated cavity to atmosphere. In the embodiment shown, the ports 320 each include a boss 322 that extends into an associated cavity. The bosses 322 in some embodiments have a height dimension that is about half as great as the depth of the bottom surfaces 312. The bosses 322, in some embodiments, may limit ink from passing through the port 320 in situations where there is ink in the cavity and a back surface 326 of the cavity is substantially horizontal or tipped substantially away from the normal vertical orientation. Further, each of the ports 320 may be exposed to atmosphere via a labyrinth 340. The labyrinths 340 may be formed by grooves in a rear surface 350 of the vent chamber 300, such as by molding, and then covering the grooves with a suitable cover 352 (shown in phantom lines), such as a pressure sensitive adhesive tape, for example. The labyrinth 340 permits air to vent to atmosphere, but limits the flow of ink or froth out of the vent chamber 300.

A recess 321 is formed in the rear surface 350 of the vent chamber 300 around each of the ports 320. Each recess 321 is in direct fluid communication with an associated labyrinth 340. A relief groove 323 is formed in the rear surface 350 of the vent chamber adjacent each recess 321, but not in fluid communication with the associated recess 321. In this configuration, if a labyrinth 340 becomes clogged, blocked, or otherwise limited in ability to adequately vent from the port 320 to atmosphere, pressure within the recess 321 may increase, thereby lifting the cover 352 slightly from around the recess 321. When the cover 352 lifts from around the recess 321, the cover 352 becomes disconnected from the portion of the rear surface 350 disposed between the relief groove 323 and the recess to permit fluid to pass from the port 320 to atmosphere via the relief groove 323. Hence, the labyrinth 340 may serve as a primary conduit for venting the port 320 to atmosphere and the relief groove 323 may serve as a secondary conduit for venting the port 320 to atmosphere when the labyrinth 340 is blocked.

A cover (not shown) is also disposed opposite the back surface 326 to maintain the ink, air, froth, or combination of these, within the cavities 302*a-f*. The vent chamber 300 shown in FIGS. 3 and 4 may comprise a plastic molded part and the cover 360 may comprise a film, such as a pressure sensitive adhesive tape or other suitable cover.

In operation, froth is advanced into one or more of the cavities 302*a-f* via a fluidic interface 306. While in the cavity, the froth may coalesce into liquid ink. Excess air may be expelled to atmosphere via an associated port 320. The liquid ink flows down the surface 312 to the interface 306. From the interface 306, the ink may be advanced to a reservoir and/or print head.

Figure 6:
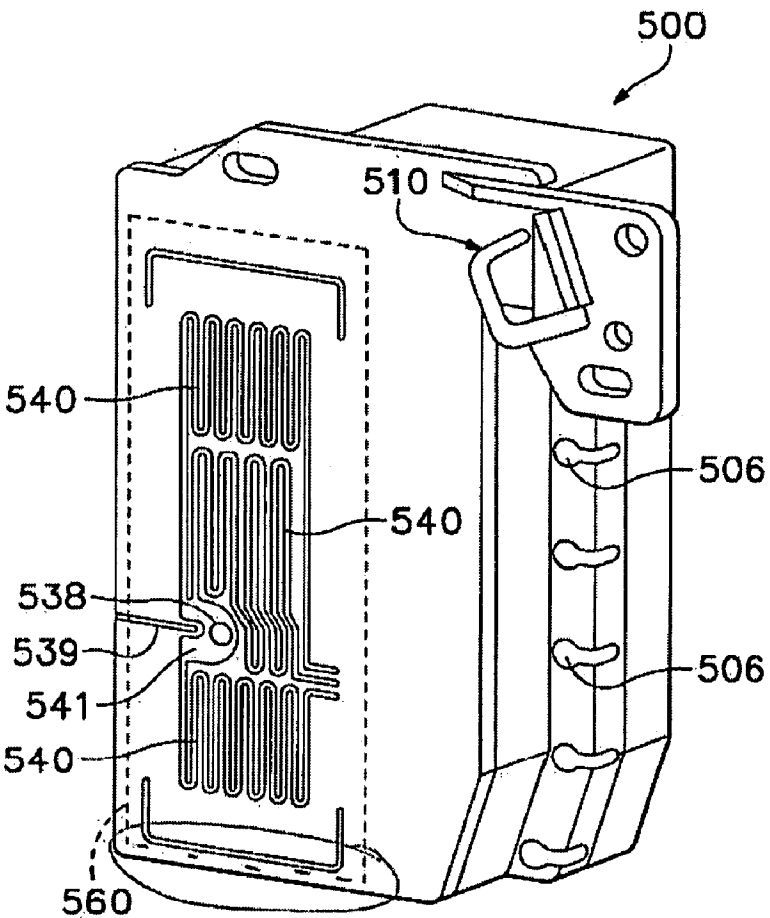
FIG. 6 is a perspective view of the vent chamber of FIG. 5 in accordance with an example embodiment.
Figure 5:
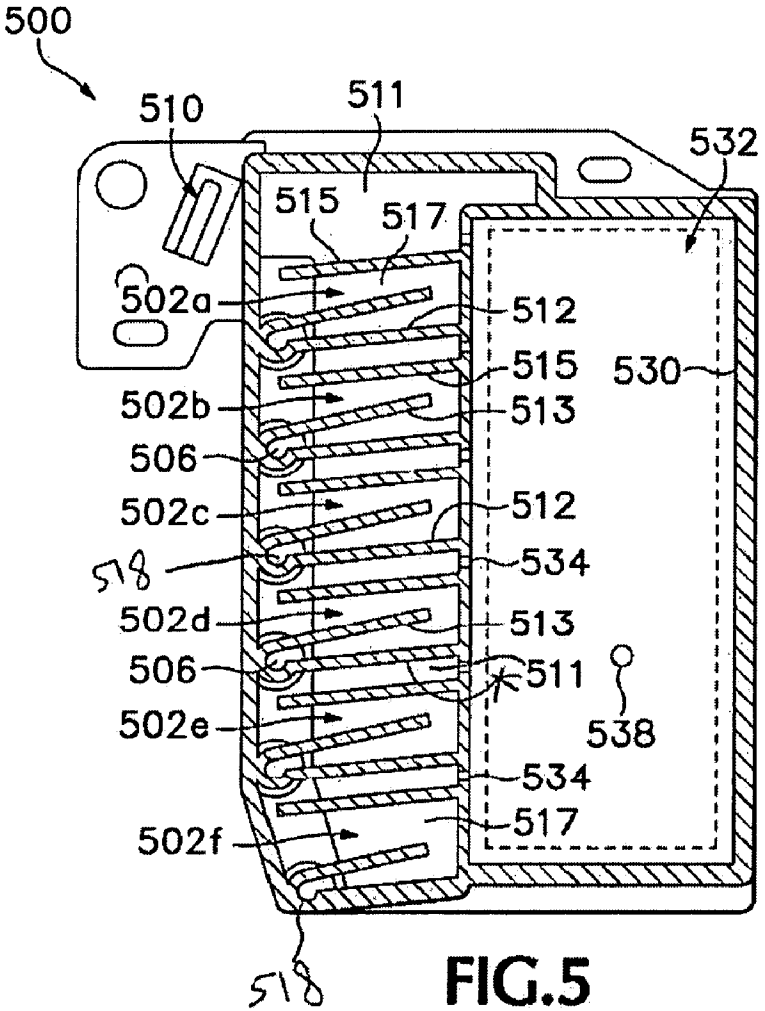
FIG. 5 is a sectional view of a vent chamber in accordance with another example embodiment.

FIGS. 5 and 6 illustrate a vent chamber 500, pursuant to another example embodiment. The vent chamber 500 may be used in an imaging device, such as the imaging device 200 shown in FIG. 2 by replacing the vent chambers 208*a-n*. As shown, the vent chamber 500 includes cavities 502*a*, 502*b*, 502*c*, 502*d*, 502*e*, 502*f*. Fluidic interfaces 506 are formed in the vent chamber 500. Each fluidic interface 506 is in fluid communication with one of the cavities 502*a-f*. The fluidic interfaces 506 may be coupled to fluid conduits, such as fluid conduits 234 (FIG. 2), to fluidly couple the cavities 502*a-f* to one of the reservoirs 206*a-n*. As shown, the fluidic interfaces 506 are vertically aligned, adjacent each other and are formed on a common side of the vent chamber 500 to facilitate coupling of fluid conduits to the fluid interfaces 506.

An optional clip 510 is provided to maintain fluid conduits (not shown), such as the conduits 234 (FIG. 2) while the conduits 234 are coupled to the interfaces 506. In the embodiment shown in FIGS. 5 and 4, the clip 510 is formed on a same side of the vent chamber 500 as the fluidic interfaces 506.

Each of the cavities 502*a-f* includes a bottom surface 512 that is sloped downward toward a fluidic interface 506. For each cavity, the lower portion or end of the bottom surface 512 is at or adjacent a fluidic interface 506. The slope of the bottom surface 512 assists ink, such as coalesced ink, in one of the cavities 502*a-f* to flow to the associated fluidic interface 506 under the influence of gravity. This may facilitate moving ink in one of the cavities 502*a-f* to an associated reservoir, such as one of the reservoirs 206*a-n* (FIG. 2). In the embodiment shown in FIG. 5, the bottom surfaces 512 may each include a groove 518 formed adjacent the associated fluidic interface 506. Coalesced ink may fill the grooves 518 in some embodiments.

The cavities 502*a-f* are also shown as each including an intermediate wall 513 or shelf. The intermediate walls 513 are spaced from the bottom surfaces 512 and may extend from a point adjacent the associated fluidic interface 506 in a direction that is slightly divergent from the associated bottom surface 512. In this configuration, the distance between an intermediate wall 513 and the associated bottom surface 512 increases as the wall 513 extends away from the associated fluidic interface 506.

As such, in some embodiments, and without being limited to or bound to any particular theory, as froth enters the vent chamber 500 at a fluidic interface 506 the associated wall 513 may help guide the froth in such a way so as to substantially fill a lower section of the associated cavity before beginning to fill the upper portion 511 of the cavity. This may reduce amounts of ink or froth expelled from cavity through the aperture 534. The wall 513 is, of course, optional, and may or may not be present in different embodiments.

Again, without being limited to or bound to any particular theory, as froth enters the space between the a wall 513 and an associated bottom surface 512, froth bubbles may be drawn apart by the diverging walls. Surface tension holds bubbles as buoyancy moves them up the diverging channel. Some of the froth bubbles may pop or coalesce as they are drawn apart. This drawing apart of the froth bubbles may not be present in all embodiments.

The cavities 502*a-f* are shown as also including upper portions 511 and a lower portions 517 separated by walls 515. The upper portion 511 of cavity 502*a* is significantly larger than the upper portions of the other cavities and provides additional volume to the cavity 502*a* such that the total volume of the cavity 502*a* is substantially larger than the volume of any one of the other cavities 502*b-f*. In some embodiments, the fluidic interface 506 associated with the cavity 502*a* may be coupled to black ink in applications where black ink is used more than colored inks. Thus, the cavity 502*a* is configured to have more volume than the other cavities to accommodate additional ink, froth, and air. The reservoir to which the cavity 502*a* is fluidly coupled may have larger volume than the other reservoirs in some applications.

An absorber compartment 530 may also be formed in the vent chamber 500 to maintain an absorber 532 therein. The absorber 532 (shown in phantom lines) may comprise any of a variety of suitable absorbent materials. The compartment 530 is in fluid communication with upper portions 511 of each of the cavities 502*a-f* via apertures 534. The compartment 530 is exposed to atmosphere via aperture 538 and labyrinths 540. The aperture 538 may be disposed in a recess 541 (FIG. 6). The labyrinths 540 are in fluid communication with the recess 541. While the vent chamber 500 is shown as including three labyrinths 540 in fluid communication with the aperture 538, a single labyrinth or a different number of labyrinths may be employed, depending on the degree of redundancy desired. With multiple labyrinths 540, if one labyrinth 540 becomes clogged or blocked, fluid may still pass through another labyrinth 540.

In this configuration, air from the cavities 502*a-f* may be vented to atmosphere. If ink passes from one or more of the cavities 502*a-f* through the apertures 534 into the compartment 530, the ink may be at least partially absorbed by the absorber 532 to limit or prevent ink from exiting the vent chamber 500 via the aperture 538 and labyrinth 540. A cover 560 is disposed over grooves that form the labyrinth 540. The vent chamber 500 also includes relief groove 539. The relief groove 539 and recess 541 may function in a manner similar to the relief grooves and recesses described above with reference to FIG. 3.

While FIG. 5 illustrates the vent chamber 500 as a cross-section, the vent chamber 500 may be formed as a molded plastic part. The side of the vent chamber opposite the labyrinths 540 may include a cover (not shown), such as a film, to cover and seal and separate the various cavities 502*a-f* and the compartment 530.

Figure 7:
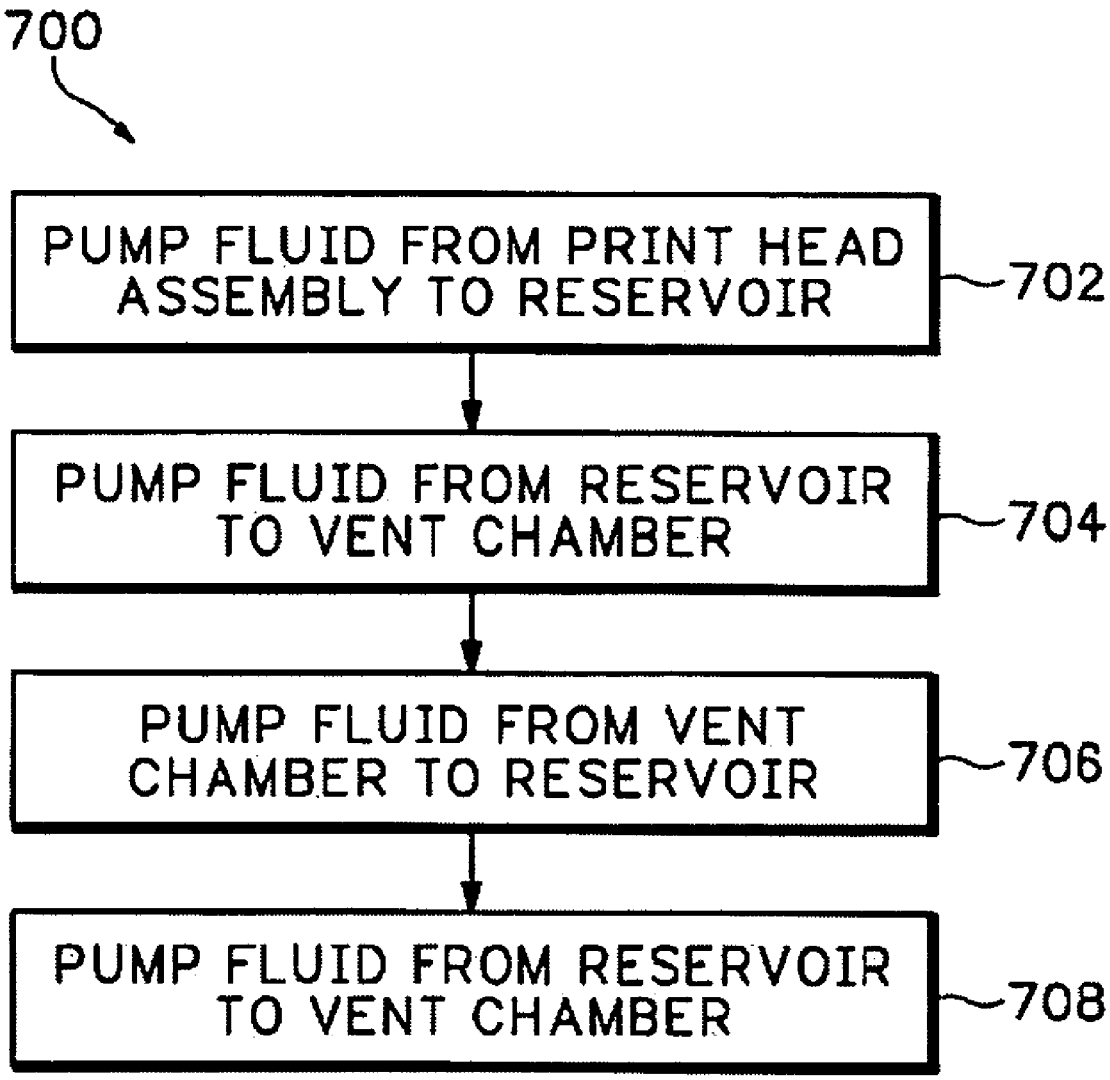
FIG. 7 is a flowchart illustrating a method in accordance with an example embodiment.

FIG. 7 is a flowchart 700 illustrating a method of operation in accordance with an example embodiment. At block 702 the pump 104 (FIG. 1) pumps fluid from the print head assembly 102 to the reservoir 106. The fluid may comprise ink, air, froth, or a combination of these. At block 704, the pump 104 pumps fluid from the reservoir 106 to the vent chamber 108. While the fluid is at the vent chamber 108, at least a portion of any froth disposed in the vent chamber 108 may be permitted to coalesce. Excess air may be vented to atmosphere at the vent chamber 108. At block 706, the pump 104 pumps fluid, including ink, from the vent chamber 108 to the reservoir 106. At block 708, the pump 104 pumps fluid, including ink, from the reservoir 106 to the print head assembly 102.

In some embodiments, blocks 702, 704 occur simultaneously, rather than sequentially. Likewise, in some embodiments, blocks 706, 708 occur simultaneously, rather than sequentially.

In some applications, embodiments of the method illustrated in FIG. 7 may be employed to refill the print head assembly 102 with ink. In other applications, embodiments of the method illustrated in FIG. 7 may be employed to cool ink within the print head assembly 102. Further, in other applications, embodiments of the method illustrated in FIG. 7 may be used to remove at least a portion of the froth from the print head assembly 102, the reservoir 106, or both.

Although the foregoing has been described with reference to exemplary embodiments, workers skilled in the art will recognize that changes may be made in form and detail without departing from the spirit and scope thereof. For example, although different exemplary embodiments may have been described as including one or more features providing one or more benefits, it is contemplated that the described features may be interchanged with one another or alternatively be combined with one another in the described exemplary embodiments or in other alternative embodiments. The present inventions described with reference to the exemplary embodiments and set forth in the following claims are manifestly intended to be as broad as possible. For example, unless specifically otherwise noted, the claims reciting a single particular element also encompass a plurality of such particular elements.

The invention claimed is:

1. A device, comprising:

a media input;

a media output;

a fluid ejection mechanism configured to eject fluid onto media received from the input;

a first reservoir;

a pump fluidly connected to and between the fluid ejection mechanism and the reservoir, the pump being configured to pump fluid between the fluid ejection mechanism and the reservoir;

a vent chamber fluidly coupled to the reservoir, the vent chamber having an atmospheric port exposed to atmosphere;

the reservoir fluidly connected to and between the vent chamber and the pump.

2. The device of claim 1, wherein the fluid ejection mechanism comprises an inkjet print head.

3. The device of claim 1, wherein the vent chamber comprises:

a cavity having a bottom surface;

a recess formed in the bottom surface;

a fluidic interface at least partially disposed in the recess.

4. The device of claim 1, wherein the vent chamber comprises a cavity having at least two walls formed therein.

5. The device of claim 1, wherein the vent chamber has a bottom surface that is sloped relative to the direction of gravity downward to an outlet port at or adjacent the bottom surface and configured to direct fluid out of the vent chamber to the first reservoir.

6. The device of claim 1, wherein the vent chamber comprises:

a fluid interface;

a bottom surface sloped in the direction of gravity downward to the fluid interface, the fluid interface disposed adjacent a lower portion of the bottom surface and configured to direct fluid out of the vent chamber to the first reservoir.

7. The device of claim 1, wherein the vent chamber comprises:

a fluid interface at a first side of the chamber;

the port being at the first side of the chamber.

8. The device of claim 1, wherein the first reservoir has first and second ports, the first port being coupled to the pump and the second port being coupled to the vent chamber.

9. The device of claim 1, wherein the vent chamber includes a cavity having a bottom surface and a wall formed within the cavity and extending in a direction divergent from the bottom surface.

10. The device of claim 9, wherein the cavity extends on opposite faces of the wall.

11. The device of claim 1, wherein the vent chamber comprises:

a cavity;

a fluid interface in fluid communication with the cavity and the first reservoir;

a labyrinth in fluid communication with the cavity and in fluid communication to atmosphere.

12. The device of claim 1, further comprising:

a plurality of fluid ejection mechanisms coupled to the pump;

a plurality of first reservoirs coupled to the pump a plurality of vent chambers, each vent chamber being fluidly coupled to at least one of the first reservoirs.

13. The device of claim 12, wherein at least one of the reservoirs has black ink disposed therein and the vent chamber fluidly coupled to the reservoir having black ink disposed therein is larger than at least one of the other vent chambers.

14. The device of claim 1, wherein the vent chamber comprises an absorber.

15. The device of claim 1, wherein the vent chamber comprises a cavity having an annular boss disposed therein, the annular boss being hollow and in fluid communication with the port.

16. The device of claim 1, wherein the vent chamber further comprises a cavity defined by top and bottom surfaces and at least one side surface, the bottom surface being oriented at an angle in the range of 4 to 15 degrees relative to the side surface.

17. The device of claim 1, further comprising:

top and bottom surfaces of the vent chamber;

a shelf disposed within the vent chamber between the top and bottom surfaces of the vent chamber;

a fluidic interface fluidly exposed to the vent chamber between the shelf and the bottom surface of the vent chamber.

18. The device of claim 1 further comprising a second reservoir adjacent the fluid ejection mechanism and configured to contain fluid to be applied by the fluid ejection mechanism.

19. The device of claim 1, wherein the pump is configured to pump fluid from the reservoir into the vent chamber.

20. The device of claim 19, wherein the pump is configured to pump fluid from the vent chamber to the reservoir.

21. An imaging device, comprising:

a print head;

a pump coupled to the print head;

first reservoirs coupled to the pump for delivering ink to and receiving ink from the print head under influence of the pump, wherein the pump is fluidly connected between the first reservoirs and the print head and wherein at least two of the first reservoirs contain ink of a different color;

a receptacle having cavities, individual ones of the cavities being fluidly coupled to individual ones of the first reservoirs, wherein the individual ones of the first reservoirs are fluidly connected between the pump and the receptacle.

22. The imaging device of claim 21, wherein the cavities are isolated from one another and wherein each of the cavities has its own first port fluidly coupled to at least one of the first reservoirs and has its own second port exposed to atmosphere.

23. The imaging device of claim 21, further comprising labyrinths, each labyrinth having a first end exposed to atmosphere and a second end exposed at one of the cavities.

24. The imaging device of claim 21, wherein the receptacle further comprises an absorbent material.

25. The imaging device of claim 21, wherein the receptacle further comprises a plurality of fluidic interfaces disposed on a common exterior surface of the receptacle.

26. The device of claim 21 further comprising a second reservoir adjacent the print head and configured to receive ink from and deliver ink to the first reservoirs under influence of the pump.

27. A device comprising:

a fluid ejection mechanism;

a reservoir;

a pump fluidly connected to and between the fluid ejection mechanism and the reservoir, the pump being configured to pump fluid between the fluid ejection mechanism and the reservoir;

a vent chamber fluidly coupled to the reservoir, the vent chamber having a port exposed to atmosphere, wherein the vent chamber has a bottom surface that is sloped relative to the direction of gravity downward to an outlet port at or adjacent the bottom surface and configured to direct fluid out of the vent chamber to the reservoir.

28. The device of claim 27, wherein the pump is configured to pump fluid from the reservoir into the vent chamber.

29. The device of claim 28, wherein the pump is configured to pump fluid from the vent chamber to the reservoir.

30. The device of claim 27, wherein the reservoir is fluidly connected to and between the vent chamber and the pump.

31. A device comprising:

a fluid ejection mechanism;

a reservoir;

a pump fluidly connected to and between the fluid ejection mechanism and the reservoir, the pump being configured to pump fluid between the fluid ejection mechanism and the reservoir;

a vent chamber fluidly coupled to the reservoir, the vent chamber having a port exposed to atmosphere, wherein the vent chamber farther comprises a cavity defined by top and bottom surfaces and at least one side surface, the bottom surface being oriented at an angle in the range of 4 to 15 degrees relative to the side surface, wherein the pump is configured to pump fluid from the reservoir into the vent chamber and wherein the pump is configured to pump fluid from the vent chamber to the reservoir.

32. The device of claim 31, wherein the reservoir is fluidly connected to and between the vent chamber and the pump.

33. A device, comprising:

a fluid ejection mechanism;

a first reservoir;

a pump configured to pump fluid between the fluid ejection mechanism and the reservoir;

a vent chamber fluidly coupled to the reservoir, the vent chamber having a port exposed to atmosphere, wherein the vent chamber comprises:

a cavity;

a fluid interface in fluid communication with the cavity and the first reservoir;

a labyrinth in fluid communication with the cavity and in fluid communication to atmosphere;

the reservoir fluidly connected between the vent chamber and the pump.

34. A device, comprising:

a fluid ejection mechanism;

a first reservoir;

a pump configured to pump fluid between the fluid ejection mechanism and the reservoir;

a vent chamber fluidly coupled to the reservoir, the vent chamber having a port exposed to atmosphere;

the reservoir fluidly connected between the vent chamber and the pump, the device further comprising:

a plurality of fluid ejection mechanisms coupled to the pump;

a plurality of first reservoirs coupled to the pump a plurality of vent chambers, each vent chamber being fluidly coupled to at least one of the first reservoirs.

35. A device, comprising:

a fluid ejection mechanism;

a first reservoir;

a pump configured to pump fluid between the fluid ejection mechanism and the reservoir;

a vent chamber fluidly coupled to the reservoir, the vent chamber having a port exposed to atmosphere;

the reservoir fluidly connected between the vent chamber and the pump, the device further comprising:

top and bottom surfaces of the vent chamber;

a shelf disposed within the vent chamber between the top and bottom surfaces of the vent chamber;

a fluidic interface fluidly exposed to the vent chamber between the shelf and the bottom surface of the vent chamber.

* * * * *

UNITED STATES PATENT AND TRADEMARK OFFICE

CERTIFICATE OF CORRECTION

PATENT NO. : 7,726,786 B2
APPLICATION NO. : 10/947514
DATED : June 1, 2010
INVENTOR(S) : Patrick J. Therien et al.

It is certified that error appears in the above-identified patent and that said Letters Patent is hereby corrected as shown below:

In column 8, line 54, in Claim 31, delete "farther" and insert -- further --, therefor.

Signed and Sealed this

Twenty-sixth Day of October, 2010

David J. Kappos

David J. Kappos
*Director of the United States Patent and Trademark Office*